US007716786B2

(12) United States Patent
Shen

(10) Patent No.: US 7,716,786 B2
(45) Date of Patent: May 18, 2010

(54) SLIDE HINGE

(75) Inventor: Wen-Bin Shen, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 373 days.

(21) Appl. No.: 12/002,500

(22) Filed: Dec. 17, 2007

(65) Prior Publication Data

US 2009/0151119 A1 Jun. 18, 2009

(51) Int. Cl.
*E05D 7/06* (2006.01)

(52) U.S. Cl. ..... 16/239; 16/243; 16/258; 16/295; 16/308; 16/352

(58) Field of Classification Search ..... 16/239, 16/243, 248, 258, 277, 286, 295, 296, 308, 16/352; 361/679.01–679.02, 679.09, 679.21, 361/679.26–679.28, 679.55, 679.57; 379/433.11–433.12; 455/575.1, 575.3, 575.4
See application file for complete search history.

(56) References Cited

U.S. PATENT DOCUMENTS 6,822,871 B2 * 11/2004 Lee et al. ..... 361/727
7,499,266 B2 * 3/2009 Jeong et al. ..... 361/679.01
7,542,788 B2 * 6/2009 Lee ..... 455/575.4
7,574,243 B2 * 8/2009 Lee ..... 455/575.4
2004/0228074 A1 * 11/2004 Tu et al. ..... 361/679
2005/0078443 A1 * 4/2005 Lee et al. ..... 361/683
2005/0082372 A1 * 4/2005 Lee et al. ..... 235/472.01
2006/0209505 A1 * 9/2006 Kim ..... 361/683
2007/0249394 A1 * 10/2007 Bong Doo ..... 455/556.1
2007/0252202 A1 * 11/2007 Park et al. ..... 257/335
2009/0027837 A1 * 1/2009 Cho et al. ..... 361/679.01
2009/0029748 A1 * 1/2009 Lee ..... 455/575.4
2009/0147451 A1 * 6/2009 Yeh ..... 361/679.01
2009/0147453 A1 * 6/2009 Hsieh et al. ..... 361/679.02

* cited by examiner

*Primary Examiner*—Victor Batson
*Assistant Examiner*—Roberta Delisle
(74) *Attorney, Agent, or Firm*—William E. Pelton, Esq.; Cooper & Dunham LLP

(57) ABSTRACT

A slide hinge is connected a cover to a base of a portable electronic device and has a stationary bracket, two pivot members, a sliding bracket and two torsion springs. The pivot members are mounted rotatably on the sliding bracket and are mounted to the base. The sliding bracket is mounted slidably on the stationary bracket and is mounted to the cover. The torsion springs are connected between the stationary bracket and the sliding bracket and each torsion spring multiple looped segments. The torsion springs with the looped segments provide an excellent resilient force to position the stationary bracket in one edge of the sliding bracket and therefore stably hold the cover in opened or closed positions without inadvertently sliding relative to the base.

6 Claims, 12 Drawing Sheets

SLIDE HINGE

BACKGROUND OF THE INVENTION

1. Field of the Invention

The present invention relates to a hinge, and more particularly to a slide hinge that is used in a portable electronic device and has an excellent positioning function.

2. Description of Related Art

Portable electronic devices such as cellular phones and personal data assistant (PDA) are designed to be compact and light for handholding and carriage.

Conventional portable electronic devices have a base, a cover, an inputting interface and a liquid crystal display (LCD). The cover is connected movably to the base. The inputting interface may be a keyboard and is mounted on the base. The LCD is mounted on the cover and may be overlapped on the cover to change the portable electronic device into a compact configuration.

The portable electronic devices are classified into a sliding type and pivoting type depending on the way the cover mounted on the base.

A sliding type portable electronic device mounts the cover slidably on the base with springs selectively positioning the cover on opened or closed positions. However, the springs have insufficient forces to securely position the cover so that the cover easily slides inadvertently.

To overcome the shortcomings, the present invention provides a slide hinge to mitigate or obviate the aforementioned problems.

SUMMARY OF THE INVENTION

The main objective of the invention is to provide a slide hinge that is used in a portable electronic device and has an excellent positioning function.

A slide hinge is connected a cover to a base of a portable electronic device and has a stationary bracket, two pivot members, a sliding bracket and two torsion springs. The pivot members are mounted rotatably on the sliding bracket and are mounted to the base. he sliding bracket is mounted slidably on the stationary bracket and is mounted to the cover. The torsion springs are connected between the stationary bracket and the sliding bracket and each torsion spring multiple looped segments. The torsion springs with the looped segments provide an excellent resilient force to position the stationary bracket in one edge of the sliding bracket and therefore stably hold the cover in opened or closed positions without inadvertently sliding relative to the base.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
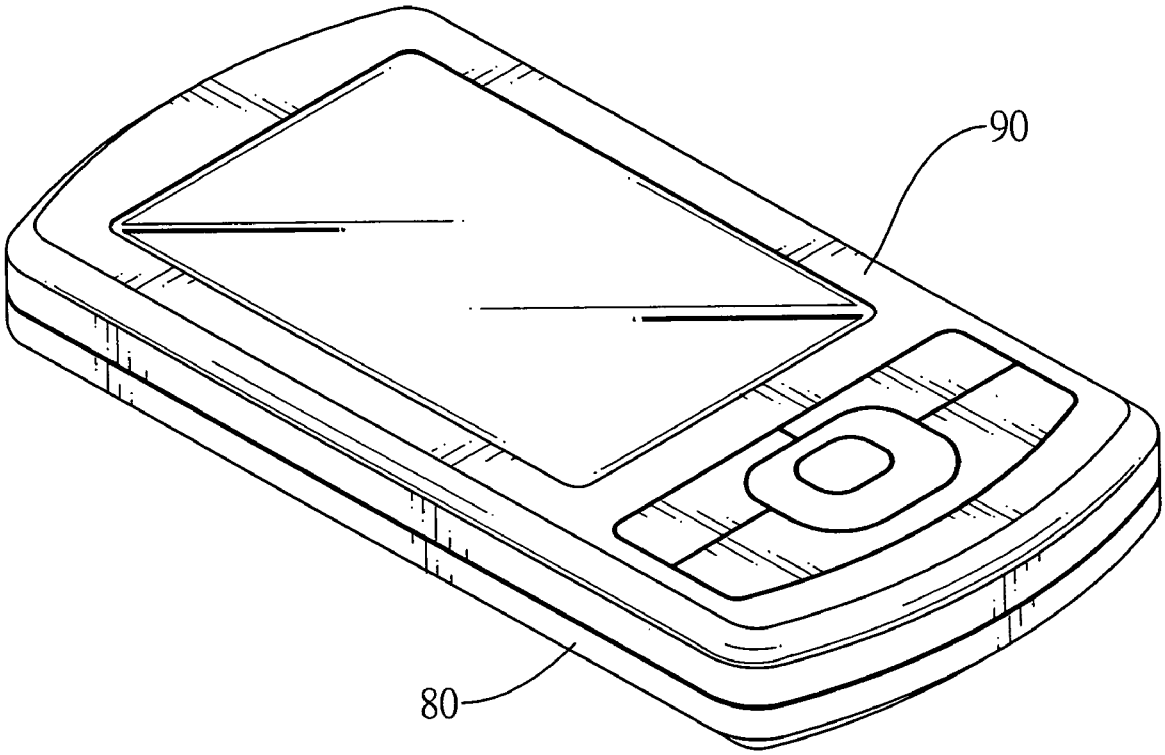
FIG. 1 is a perspective view of a cellular phone with a slide hinge in accordance with the present invention.
Figure 2:
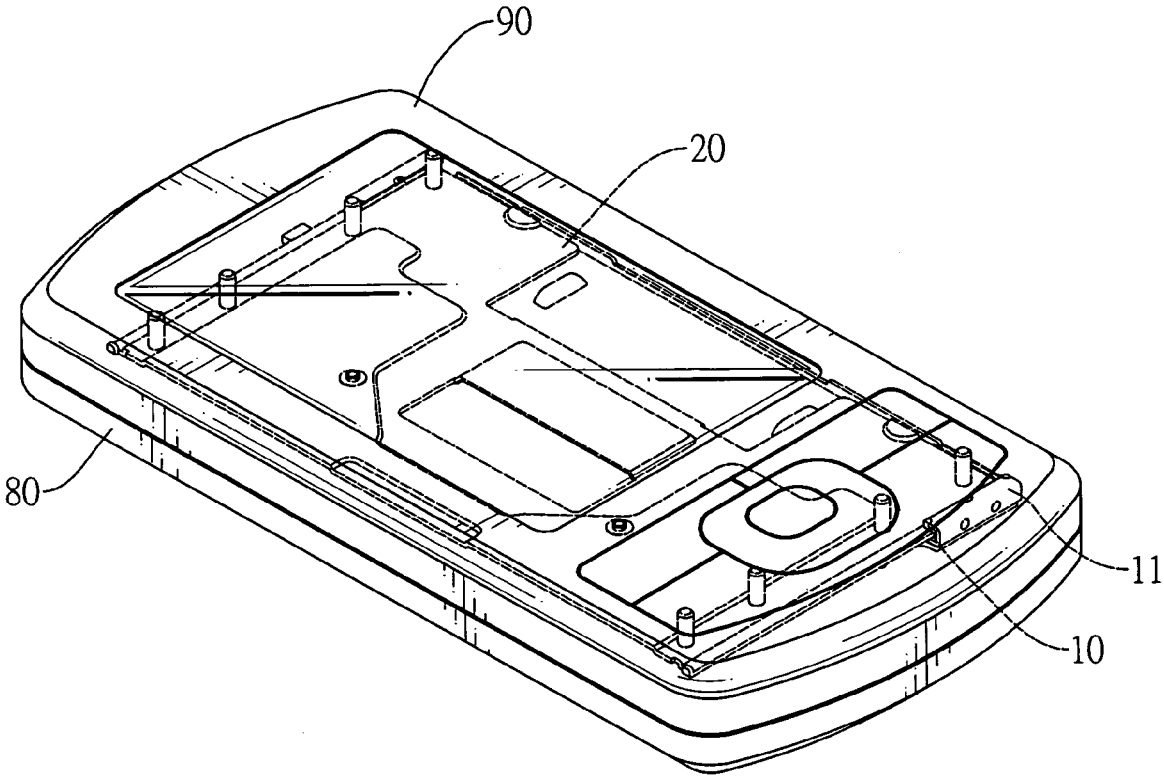
FIG. 2 is a perspective view of the cellular phone and slide hinge in FIG. 1 illustrated with phantom lines.
Figure 3:
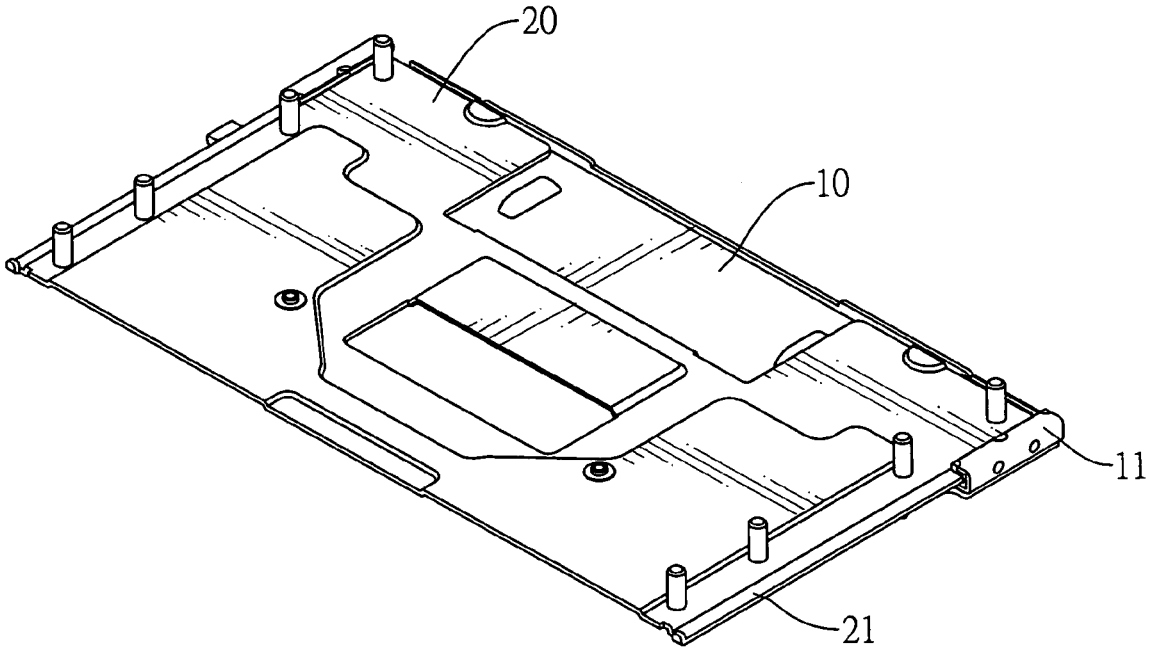
FIG. 3 is a perspective view of the slide hinge in FIG. 2 with the stationary bracket on the rear edge of the sliding bracket.

With reference to FIGS. 1 to 3, a slide hinge in accordance with the present invention is mounted on and a portable electronic device. The portable electronic device may be a cellular phone and has a base (80) and a cover (90). The base (80) has an inputting interface such as a keyboard. The cover (90) is mounted slidably and pivotally on the base (80) through the slide hinge and has a liquid crystal display (LCD).

Figure 4:
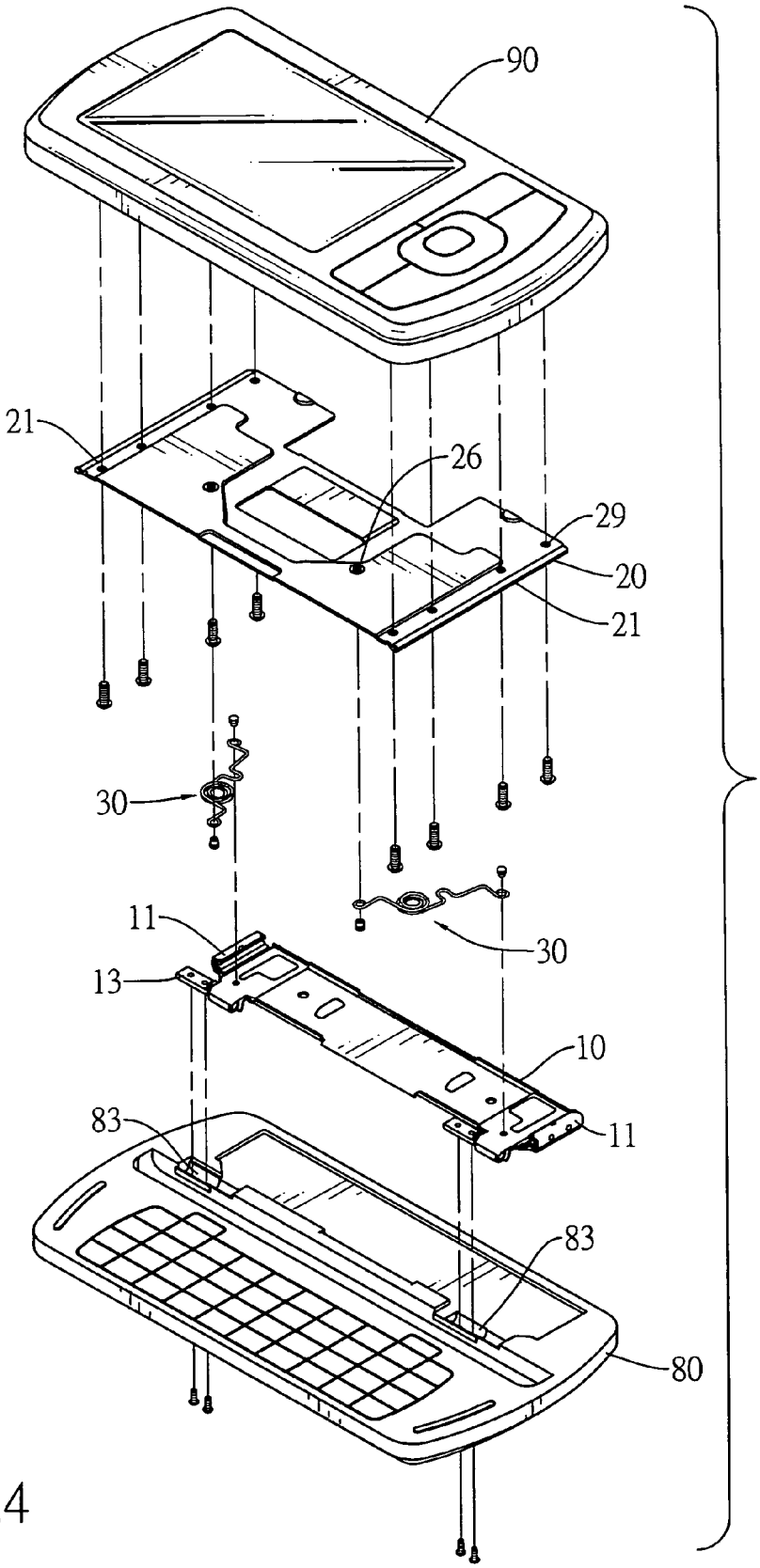
FIG. 4 is an exploded perspective view of the cellular phone and the slide hinge in FIG. 2.
Figure 5:
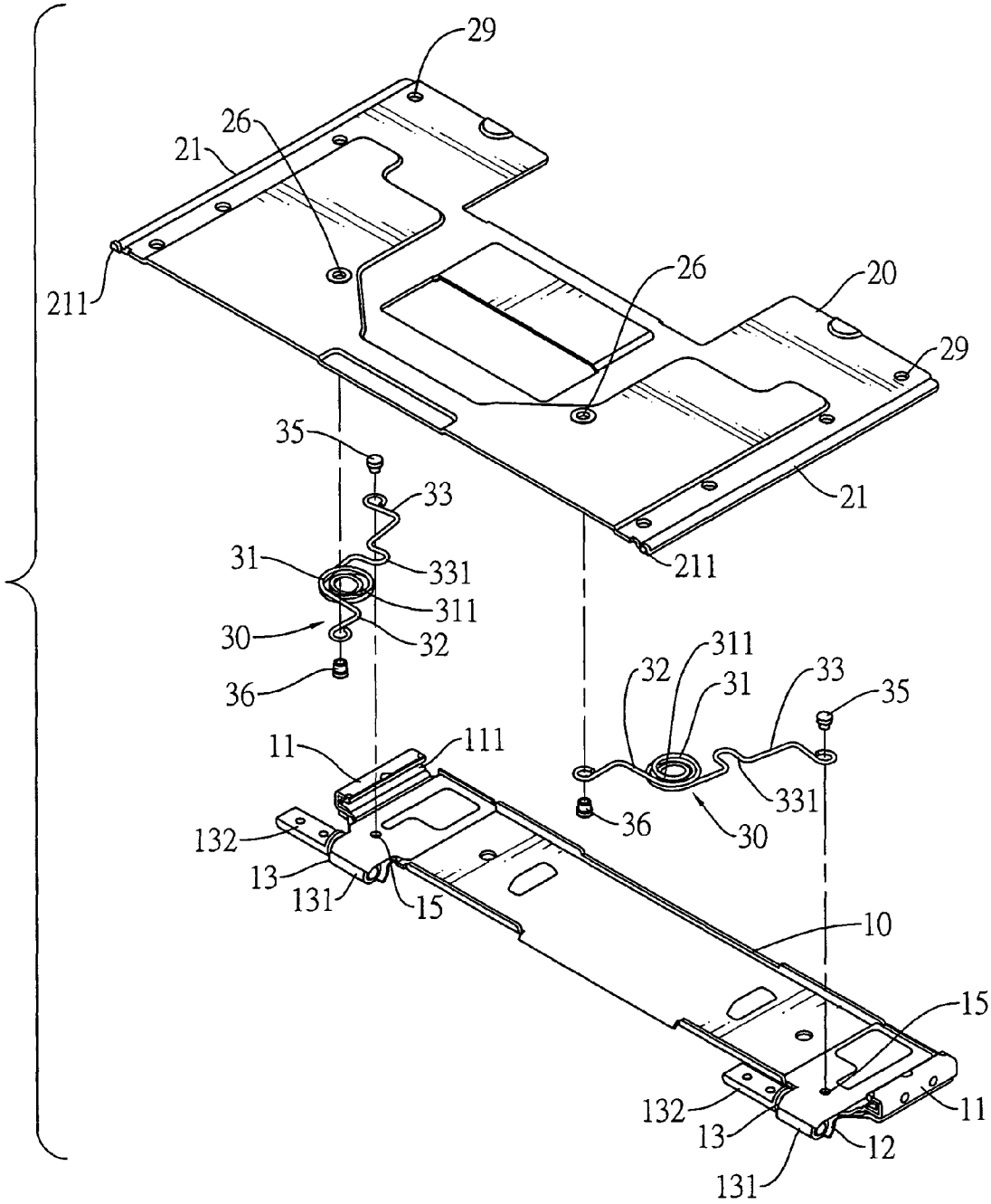
FIG. 5 is an enlarged and exploded perspective view of the slide hinge in FIG. 4.

With further reference to FIGS. 4 and 5, the slide hinge comprises a stationary bracket (10), two pivot members (13), a sliding bracket (20) and two torsion springs (30).

The stationary bracket (10) has two opposite sides, a front edge, a rear edge, two tracks (11) and two pivot mounts (12) and may further have two mounting holes (15).

The tracks (11) are longitudinally formed respectively on the sides. Each track (11) has a front end and may be C-shaped to have a track slot (11) defined longitudinally in the track (11).

The pivot mounts (12) are formed on the front edge respectively adjacent to the sides. The pivot mounts (12) may be two gapped barrels. The gapped barrels are C-shaped and are formed transversely on the front edge. Each gapped barrel has a pivot hole defined through the gapped barrel.

The mounting holes (15) are defined uprightly through the stationary bracket (10) and are located respectively near the sides.

The pivot members (13) are rotatably mounted respectively on the pivot mounts (12) and are mounted securely on the base (80) to pivotally connect the stationary bracket (10) on the base (10). Each pivot member (13) may have a pivot pin (131) and a mounting leaf (132). The pivot pin (131) is mounted rotatably in one of the pivot holes in the stationary bracket (10). The mounting leaf (132) is formed on and protrudes longitudinally from the pivot pin (131) and is mounted on the base (80) through fasteners such as bolts or rivets extending through the mounting leaf (132) into the base (80).

The sliding bracket (20) is mounted securely on and holds the cover (90), is mounted slidably on the tracks (11) of the stationary bracket (10) and has two opposite sides, a front edge and a rear edge. The sliding bracket (20) may further have two slide tabs (21), two limits (211), two mounting holes (26) and two rows of fastening holes (29).

The slide tabs (21) are formed longitudinally on and protrude respectively from the sides of the sliding bracket (20) and are slidably mounted respectively in the track slots (111) of the tracks (11).

The limits (211) are formed on and protrude perpendicularly on the front edge of the sliding bracket (20) and selectively press respectively against the front ends of the tracks (11) to prevent the sliding bracket (20) from falling out of the stationary bracket (10).

The mounting holes (26) are defined uprightly through the sliding bracket (20).

The rows of the fastening holes (29) are defined through the sliding bracket (20) and are located respectively near the slide tabs (21). Fasteners such as bolts or rivets are mounted respectively through the fastening holes (29) and mounted securely on the cover (90) to hold the cover (90) on the sliding bracket (20).

Figure 7:
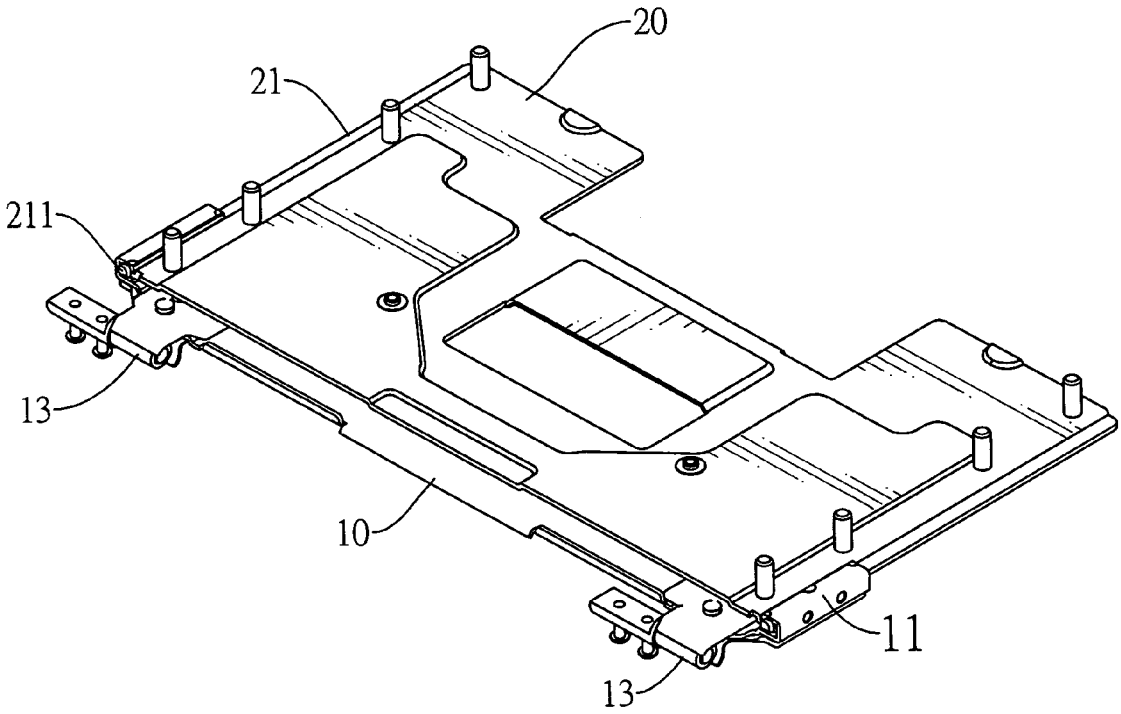
FIG. 7 is an operational perspective view of the slide hinge in FIG. 6 with the sliding bracket sliding to position the stationary bracket on the front edge of the sliding bracket.

With further reference to FIG. 7, the torsion springs (30) are connected to the stationary bracket (10) and the sliding bracket (20) and selectively bias the stationary bracket (10) on the rear edge or the front edge of the sliding bracket (20), as shown in FIGS. 3 and 7. Each torsion spring (30) has a spiral section (31), a first connecting section (32) and a second connecting section (33).

The spiral section (31) has two ends and multiple looped segments (311). The looped segments (311) are connected to one another to provide an excellent resilient force to stably position the stationary bracket (10) on the one of the front and rear edges of the sliding bracket (20) and have different diameters. Furthermore, the looped segments (311) with the different diameters encircle one another to be arranged in a substantially concentric arrangement instead of being stacked right as a conventional compression spring so that the thickness of the spiral section (31) is reduced to make the slide hinge compact.

The first connecting section (32) is formed on and protrudes from one end of the spiral section (31), may be L-shaped to be resilient and has a distal end. The distal end is connected pivotally to the sliding bracket (20) and may be a looped end connected to one mounting hole (26) in the sliding bracket (20) through a fastener (36) such as a rivet or a bolt extending through the looped end and the mounting hole (26).

The second connecting section (33) is formed on and protrudes from the other end of the spiral section (31), may be L-shaped to be resilient, has a distal end and may further have a compression segment (331). The distal end of the second connecting section (33) is connected pivotally to stationary bracket (10) and may be a looped end connected to one mounting hole (15) in the stationary bracket (10) through a fastener (35) such as a rivet or a bolt extending through the looped end and the mounting hole (15). The compression segment (331) is formed on the second connecting section (33), is U-shaped and is selectively compressed to make the second connecting section (33) resilient and deformable along a length of the section connecting section (33). With the compression segment (331), the second connecting section (33) would not inadvertent deform irreversibly during the siding of the sliding bracket (20) relative to the stationary board (10).

Figure 10:
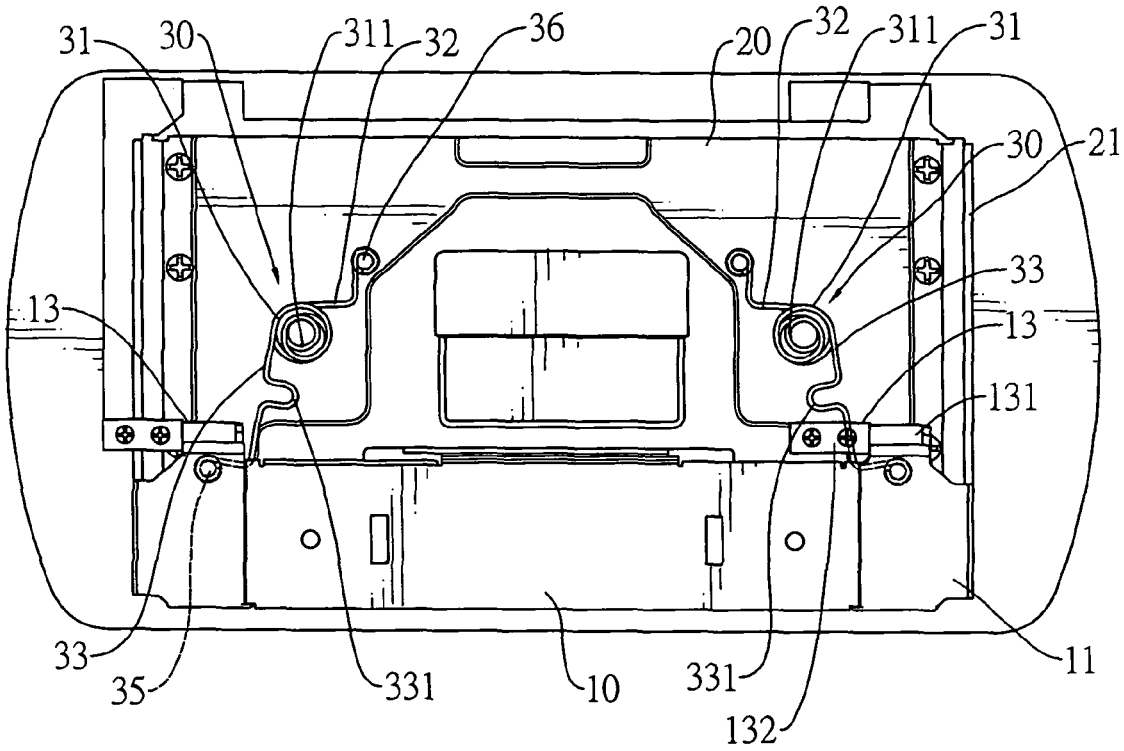
FIG. 10 is a bottom view of the cover of the cellular phone and the slide hinge in FIG. 2.

With further reference to FIG. 10, when the stationary bracket (10) is located between the front and rear edges of the sliding bracket (20), the torsion springs (30) are compressed maximally to provide a maximal resilient force pushing the stationary bracket (10) toward the front or rear edge of the sliding bracket (20).

Figure 9:
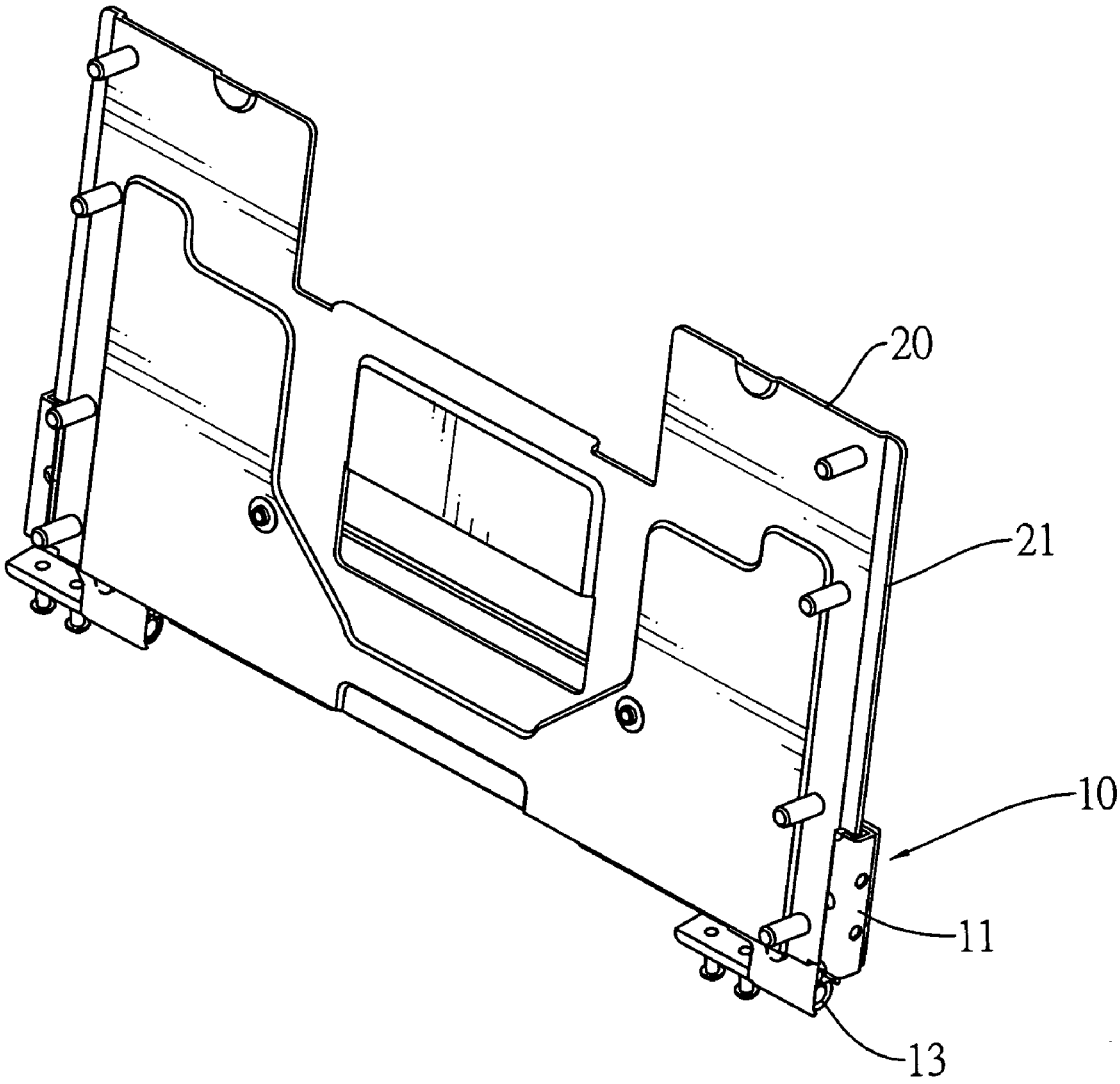
FIG. 9 is an operational perspective view of the slide hinge in FIG. 8 with the sliding bracket and the stationary bracket pivoting up relative to the pivot members.
Figure 11:
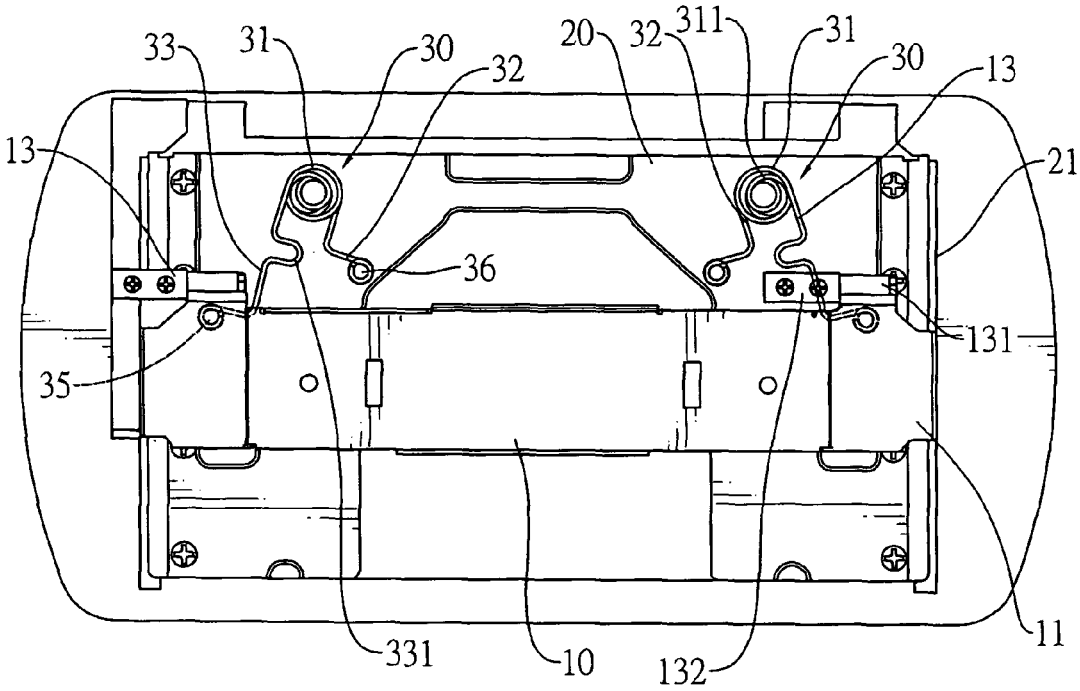
FIG. 11 is an operational bottom view of the cover of the cellular phone and the slide hinge in FIG. 10 with the torsion springs compressed maximally.
Figure 12:
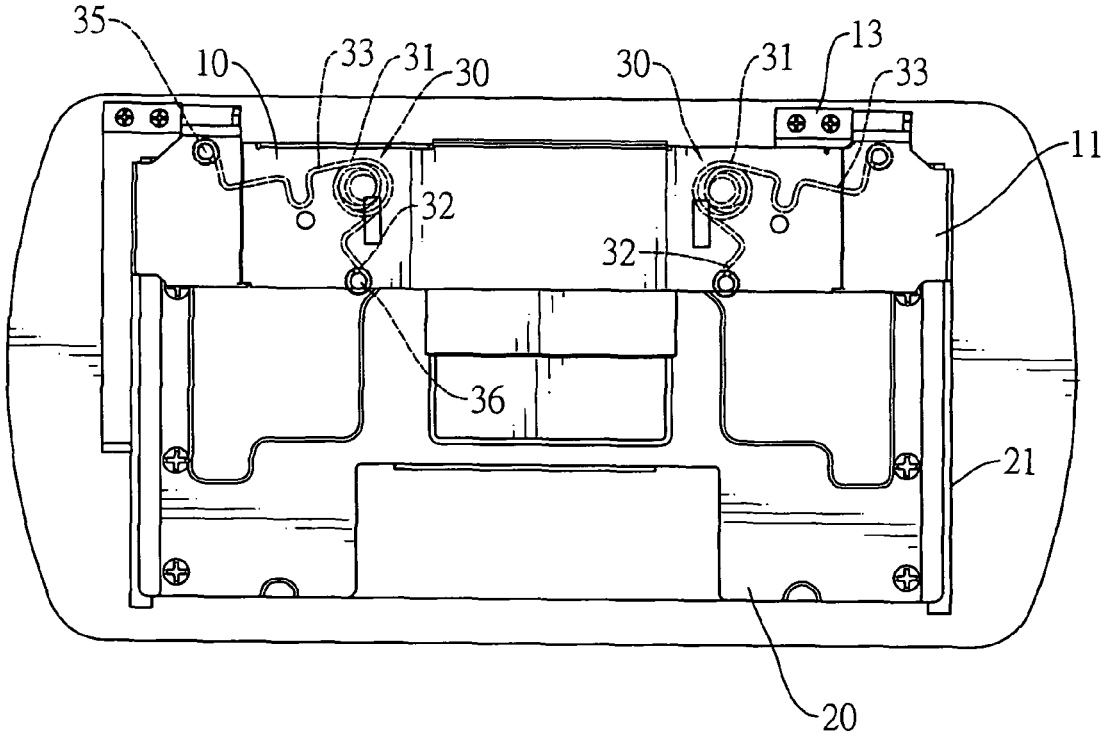
FIG. 12 is an operational bottom view of the cover and the cellular phone and the slide hinge in FIG. 11 with the torsion springs holding the sliding bracket staggered with the stationary bracket.

With further reference to FIGS. 9 and 11, when the stationary bracket (10) is located adjacent to the front or rear edge of the sliding bracket (20), the torsion springs (30) are released to provide a less and sufficient resilient force positioning the stationary bracket (10) on the front or rear edge of the sliding bracket (20).

Figure 6:
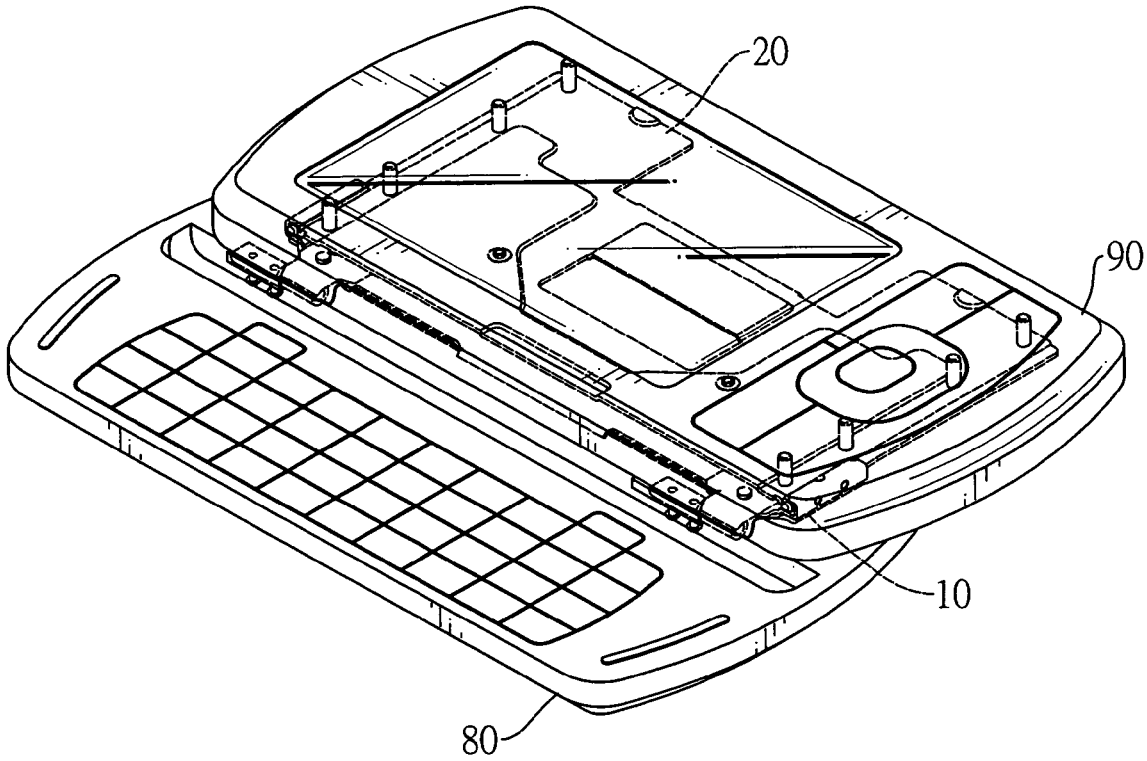
FIG. 6 is an operational perspective view of the cellular phone in FIG. 2 with the cover sliding to be staggered with the base and opened.

With further reference to FIGS. 6 and 7, to operate the portable electronic device, a user pushes the cover (90) relative to the base (80). The torsion springs (30) bias the cover (90) to be staggered with the base (80) to open the cover (90).

Figure 8:
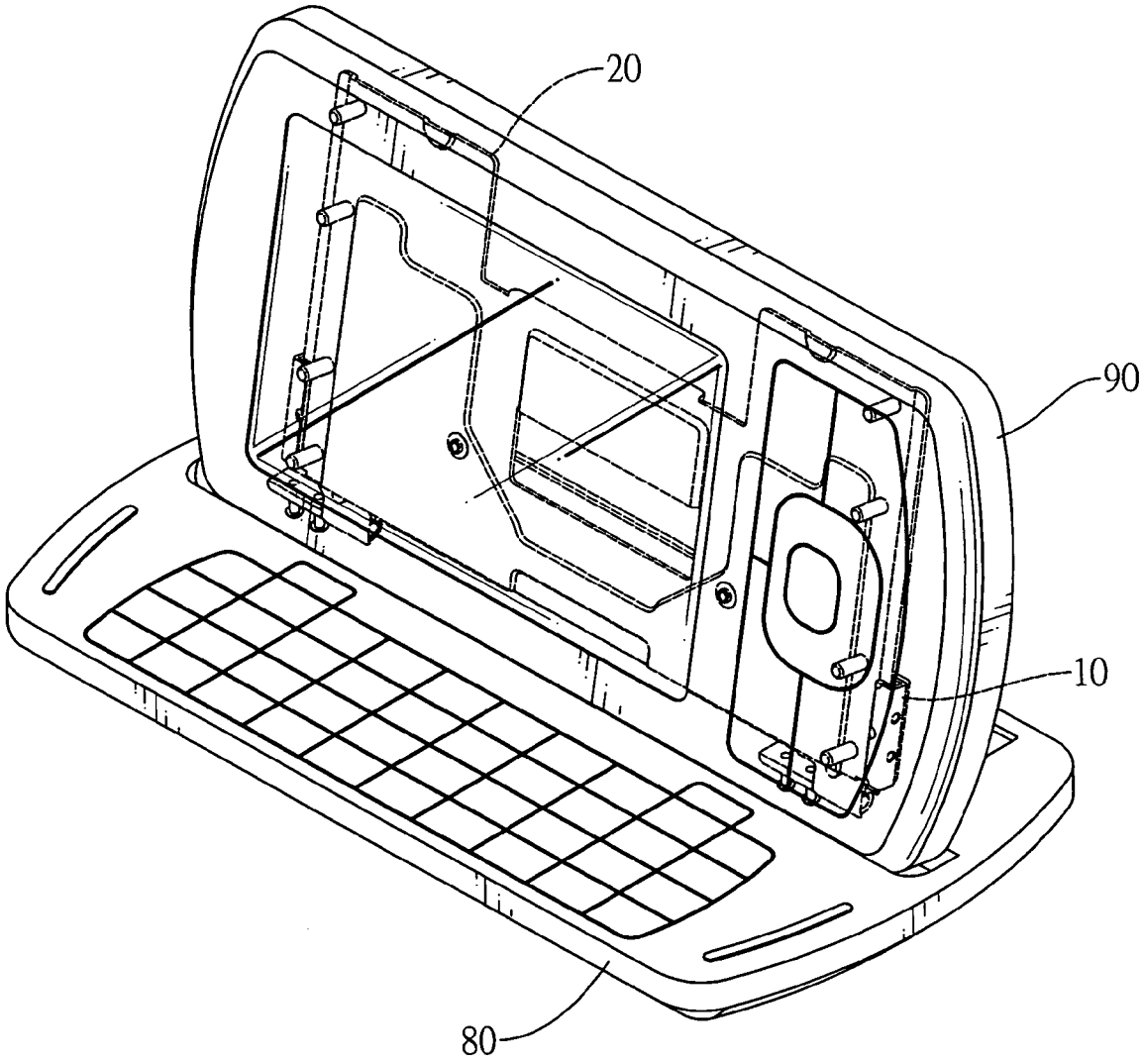
FIG. 8 is an operational perspective view of the cellular phone in FIG. 6 with cover pivoting up and standing on the base.

With further reference to FIGS. 8 and 9, the user pivots the opened cover (90) up to stand the LCD on the keyboard of the base (80) to facilitate watching the LCD and typing on the portable electronic device.

The spiral section (31) of each torsion spring (30) with the looped segments (311) provides a greater resilient force when compared to the springs in a conventional sliding type portable electronic device. Therefore, the torsion springs (30) stably hold the cover (90) opened or closed without inadvertently sliding relative to the base (80). Furthermore, the substantially concentrically arranged looped segments (311) reduce the thickness of the spiral section (31) and make the slide hinge compact.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A slide hinge comprising:

a stationary bracket having
- two opposite sides;
- a front edge;
- a rear edge;
- two tracks longitudinally formed respectively on the sides and each track having a front end; and
- two pivot mounts formed on the front edge respectively adjacent to the sides;

two pivot members rotatably mounted respectively on the pivot mounts;

a sliding bracket mounted slidably on the tracks of the stationary bracket and having two opposite sides, a front edge and a rear edge; and two torsion springs connected to the stationary bracket and the sliding bracket and selectively biasing the stationary bracket on the rear edge or the front edge of the sliding bracket, and each torsion spring having
- a spiral section having two ends; and
  - multiple looped segments connected to one another, having different diameters and encircling one another;
- a first connecting section formed on and protruding from one end of the spiral section and having a distal end connected pivotally to the sliding bracket; and
- a second connecting section formed on and protruding from the other end of the spiral section having a distal end connected pivotally to stationary bracket.

2. The slide hinge as claimed in claim 1, wherein:

each track of the stationary bracket is C-shaped and has a track slot defined longitudinally in the track; and the sliding track further has two slide tabs formed longitudinally on and protruding respectively from the sides of the sliding bracket and slidably mounted respectively in the track slots of the tracks.

3. The slide hinge as claimed in claim 2, wherein:

the stationary bracket further has two mounting holes defined uprightly through the stationary bracket and located respectively near the sides of the stationary bracket;

the sliding bracket further has two mounting holes defined uprightly through the sliding bracket;

the first connecting section of each torsion spring has the distal end being a looped end connected to one mounting hole in the sliding bracket through a fastener; and the second connecting section of each torsion spring has the distal end being a looped end connected to one mounting hole in the stationary bracket through a fastener.

4. The slide hinge as claimed in claim 3, wherein:

each pivot mount of the stationary bracket is a gapped barrel being C-shaped and having a pivot hole defined through the gapped barrel; and each pivot member has a pivot pin mounted rotatably in one of the pivot holes in the stationary bracket; and a mounting leaf formed on and protruding longitudinally from the pivot pin.

5. The slide hinge as claimed in claim 4, wherein the second connecting section of each torsion spring further has a compression segment being U-shaped, formed on the second connecting section and selectively compressed.

6. The slide hinge as claimed in claim 5, wherein the first and second connecting sections are L-shaped.

* * * * *